United States Patent [19]

Phillips et al.

[11] 4,020,838

[45] May 3, 1977

[54] ANIMAL DOSING SYRINGE

[75] Inventors: Ian Ross Phillips, Pymble; Mervyn Frank Reynolds, Dee Why, both of Australia

[73] Assignee: N.J. Phillips Pty. Limited, Dee Why, Australia

[22] Filed: Apr. 20, 1976

[21] Appl. No.: 678,578

[30] Foreign Application Priority Data

May 6, 1975 Australia ..... 1498

[52] U.S. Cl. ..... 128/223; 128/234

[51] Int. Cl.[2] ..... A61D 7/00

[58] Field of Search ..... 128/223, 234, 235, 224, 128/218 R

[56] References Cited

UNITED STATES PATENTS

| | | | |
|---|---|---|---|
| 2,074,401 | 3/1937 | Kauzal | 128/223 |
| 2,750,943 | 6/1956 | Dann | 128/235 |
| 3,682,175 | 8/1972 | Halter | 128/223 |

FOREIGN PATENTS OR APPLICATIONS

| | | | |
|---|---|---|---|
| 17,898 | 6/1935 | Australia | 128/223 |

*Primary Examiner*—John D. Yasko

*Attorney, Agent, or Firm*—Ladas, Parry, Von Gehr, Goldsmith & Deschamps

[57] ABSTRACT

A liquid dispensing gun employing two interacting bores and pistons to maintain the liquid inlet and outlet of this gun stationary with respect to the gun during operation. The gun is attachable to a liquid reservoir and may employ either a nozzle to deliver a dosage of liquid into the throat of an animal or to inject a dosage via a needle.

9 Claims, 1 Drawing Figure

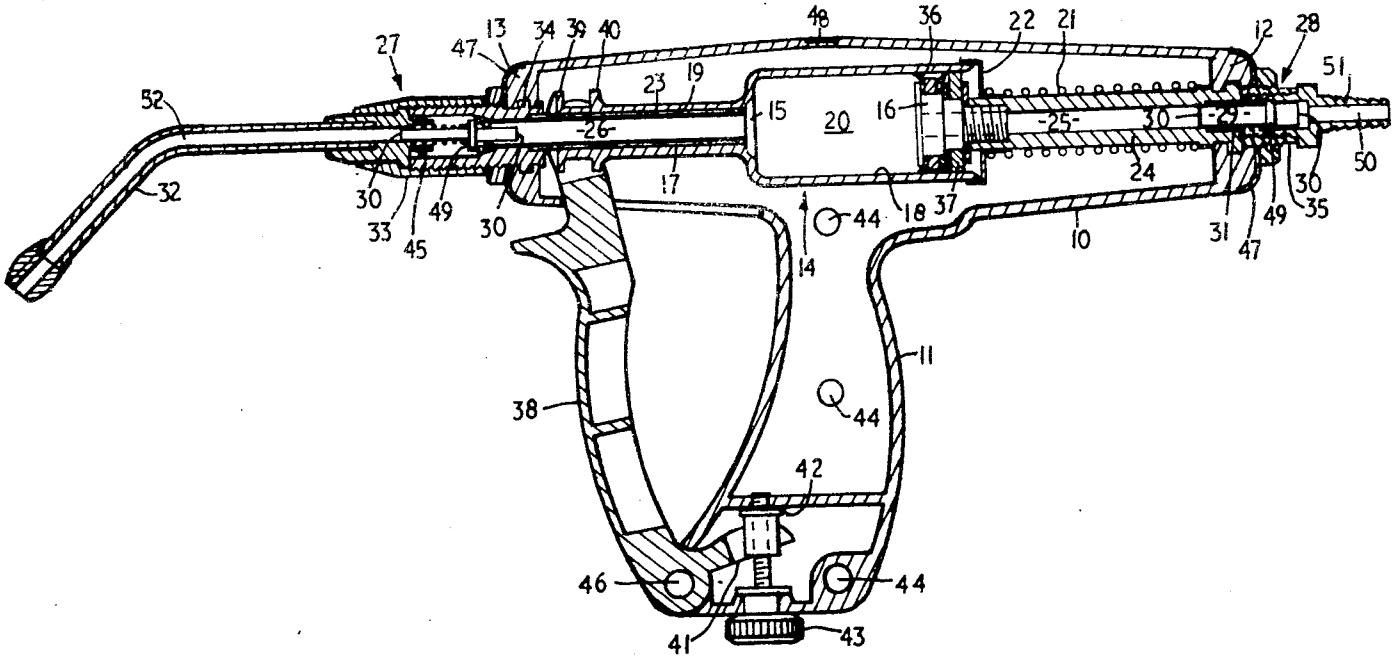
50
51
28
30
35
12
49
47
31
24
10
21
22
25
36
37
18
16
11
44
20
48
14
42
43
15
19
17
41
23
40
26
39
34
13
38
46
47
30
49
45
27
33
30
52
32

ANIMAL DOSING SYRINGE

The present invention relates to liquid dispensing guns and more particularly but not exclusively to drench guns for the dosing of animals, especially sheep.

It is desirable in devices of this kind that the liquid inlet and outlet of the gun remain stationary upon the operation of the trigger of the gun. Despite this feature being desired, many guns produced have a liquid inlet or outlet which moves in coordination with the trigger, which movement makes it difficult to hold the gun stationary.

These known guns have suffered from this defect as only one interacting bore and piston is used which necessitates the inlet or outlet of the gun being fixed to the movable piston. Known guns which do provide a stationary inlet and outlet are of a rather cumbersome and expensive construction as again only one interacting bore and piston is used.

Accordingly, it is an object of the present invention to provide a liquid dispensing gun with a stationary liquid inlet and outlet by providing the gun with two interacting bores and pistons.

The present invention provides a liquid dispensing gun having an outer body with a liquid inlet and outlet fixed thereto and which ejects a dosage of liquid drawn from a reservoir; said gun comprising a first and second chamber defined in part respectively by a first and second interacting bore and piston; the second bore being larger in diameter than, coaxial with, and fixed to, the first bore; the pistons being stationary relative to the body but movable within their respective bores to vary the volume of the chambers; means allowing the flow of liquid between the chambers; first ducting means joining the liquid inlet with the chambers and including a passage through one of the pistons; second ducting means joining the liquid outlet with the chambers and including a passage through the other piston; a one-way valve in each of the ducting means restricting the liquid to flow in only one direction through the gun; and means for moving the bores relative to the pistons to thereby cause a decrease in the total volume of the chambers and the ejection of liquid from within the chambers via said liquid outlet and second ducting means, or an increase in the total volume of the chambers and the drawing in of liquid from the reservoir via said first ducting means and liquid inlet.

The drench gun of the present description lends itself to the easy production from plastic material and is of an attractive appearance due to the molded outer casing. Still further the gun provides an improved valve arrangement and means of sealing the pistons within the cylinder.

A preferred form of the invention will now be described by way of example with reference to the accompanying drawing, wherein FIG. 1 depicts a drench gun with a nozzle employed in the dosing of animals.

The gun is depicted having an outer casing 10 of plastic material molded in two halves, of which only one is depicted, while apart from forming the body for the gun the casing 10 includes the handle 11. The working assembly of the gun is supported within the casing at points 12 and 13 thus allowing the twin chambered member 14 to move freely within the casing 10. The two halves of the casing are secured together by screws engaging threaded portions 44.

Pistons 15 and 16 are slidably located within cylinders 17 and 18 to define in part and to vary the volume of the two chambers 19 and 20. The member 14 is biased toward the portion depicted by spring 21 acting on flanged portion 22 of member 14. Extending from the pistons 15 and 16 are piston rods 23 and 24 respectively which engage the outer casing at points 12 and 13. Piston rods 23 and 24 have central passages 25 and 26 extending therethrough and which communicate with the one-way valve assemblies 27 and 28. Liquid flow through the gun is controlled by valve assemblies 27 and 28 each of which consists of a movable valve member 29 biased to engage a valve seat 49 by spring 31. Movement of each valve member 29 is guided by extension portions 30, of "X" cross section, slidably engaging the adjacent passages. From the arrangement of the valves it can be seen that fluid flows from right to left through the gun.

Liquid leaving the gun is injected into the throat of the animal via passage 52 in the nozzle 32 which is secured to valve cage 45 by nut 33. Nut 33 secures the cage 45 to the casing 11 with the aid of flange 34 and the corresponding recess in the casing. The valve cage 35 is similarly secured to the casing 10.

Connector 50 is provided with barbs 51 to engage a flexible hose leading to a reservoir of drench and threadably engages cage 35 to tension spring 31 by acting on the sealing portion of movable valve member 29.

Each piston 15 and 16 sealingly engages its corresponding cylinder wall while in addition to seal 36 there is provided a lubricating washer 37 which also engages cylinder 18 to provide a more smooth sliding motion of seal 36.

Movement of the member 14 results from the manual operation of the trigger 38 which engages cylinder 17 via a trunion (not illustrated) located between flanges 39 and 40. The dosage delivered by the movement of the trigger 38 is determined by the engagement of forked lug 41 engaging stop nut 42. Adjustment screw 43 adjusts the position of nut 42 as the nut is restrained from angular movement by forked lug 41.

The trigger 38 is pivotally attached to the casing 10 via a screw which engages the housing through opening 46 in the trigger 38. The handle 11 is formed so as to be comfortably located within the palm of an operator's hand while the fingers grip the trigger 38.

The extremities of the casing 10, namely points 12 and 13 are held together by end plate 47 while the top of the casing 10 is held together by a locking strap 48.

In operation a predetermined dosage of drench is delivered at each complete retraction of the trigger 38, the dosage is delivered through passage 52 as the total volume of the chambers decreases as member 14 moves rightward. Upon release of the trigger 38, it returns, due to spring 21, to a rest position defined by the position of stop nut 42 and draws in a new charge of drench to be discharged upon the next squeeze of the trigger 38. The fresh charge is drawn in via passage 25 from a reservoir attached to inlet nozzle 50.

While nozzle 32 is designed to deliver a dosage of drench into the throat of an animal it should be realised that the gun is just as applicable to injection equipment since an injection needle may be secured to the gun by nut 33 instead of nozzle 32.

What we claim is:

1. A liquid dispensing gun having an outer body with a liquid inlet and outlet fixed thereto and which ejects a dosage of liquid drawn from a reservoir; said gun comprising a first and second chamber defined in part respectively by a first and second interacting bore and piston; the second bore being larger in diameter than, coaxial with, and fixed to, the first bore; the pistons being stationary relative to the body but movable within their respective bores to vary the volume of the chambers; means allowing the flow of liquid between the chambers; first ducting means joining the liquid inlet with the chambers and including a passage through one of the pistons; second ducting means joining the liquid outlet with the chambers and including a passage through the other piston; a one-way valve in each of the ducting means restricting the liquid to flow in only one direction through the gun; and means for moving the bores relative to the pistons to thereby cause a decrease in the total volume of the chambers and the ejection of liquid from within the chambers via said liquid outlet and second ducting means, or an increase in the total volume of the chambers and the drawing in of liquid from the reservoir via said first ducting means and liquid inlet.

2. A liquid dispensing gun according to claim 1 wherein said means for moving the bores comprises a trigger pivotally attached at one end to a handle extending from the outer body, the pivot being located at the extremity of the handle; and a trunion at the other end of said trigger which engages one of said bores.

3. A liquid dispensing gun according to claim 2 wherein means is provided to measure the dosage delivered by the gun.

4. A liquid dispensing gun according to claim 3 wherein the means to measure the dosage delivered comprises a lug projecting from the pivoted end of said trigger, a stop nut located within the movement path of said lug, and an adjustment screw rotatably held by said handle and engaging said nut to adjust the portion where said lug and stop nut engage.

5. A drench gun having a stationary inlet and outlet to dispense a dosage of drench into an animal, said gun comprising an outer casing; a hollow member movable within said casing and having a first and second coaxial bore; a piston slidably located within each of the bores to sealingly enclose a space within the member; a piston rod extending from each of the pistons and outwardly from the bores; means securing said rods to said casing; a passage extending through each piston and its respective rod to provide communication between said space and said inlet and outlet; valve means to restrict the drench to flow in only one direction through the gun; means for moving the movable valve member relative to the pistons; and wherein said bores are of different diameters so that upon movement of said member the volume of said space is varied to cause liquid to be drawn into said gun or to be injected thereupon.

6. A drench gun according to claim 5 wherein means is provided to regulate the movement of said movable valve member to cause a predetermined dosage of said drench to be ejected from the gun.

7. A drench gun according to claim 5 wherein said movable valve member is biased by a spring toward one end of said hosing to a piston in which the volume of said space is at a maximum.

8. A drench gun according to claim 5 wherein said valve means comprises a one-way valve located in said inlet and said outlet, each one of said valves comprising a valve chamber with a coaxial inlet and outlet passage of smaller cross sectional area than said chamber, a movable sealing member having an elongated body extending through said chamber and partly into said inlet and outlet passage so as to be guided thereby during movement, a sealing portion within said chamber extending radially outward from said body to sealingly engage with the inlet passage, a spring biasing said movable valve member toward a sealing position against said inlet passage.

9. A drench gun according to claim 8 wherein said elongated body is of a "X" cross section along the portions of its length which enter the inlet and outlet passages.

* * * * *